United States Patent [19]

Goloff

[11] 4,164,957

[45] Aug. 21, 1979

[54] OIL-COOLED ENGINE VALVE

[75] Inventor: Alexander Goloff, East Peoria, Ill.

[73] Assignee: Caterpillar Tractor Co., Peoria, Ill.

[21] Appl. No.: 854,190

[22] Filed: Nov. 23, 1977

[51] Int. Cl.[2] ..... F01P 3/14; F16K 49/00; F01L 3/18

[52] U.S. Cl. ..... 137/340; 123/41.41; 123/41.34; 123/188 AA; 123/188 GC

[58] Field of Search ..... 123/41.41, 41.31, 41.34, 123/188 A, 188 AA, 188 GC; 137/340

[56] References Cited

U.S. PATENT DOCUMENTS

| | | | |
|---|---|---|---|
| 1,343,111 | 6/1920 | Cattaneo | 123/41.41 |
| 1,415,793 | 5/1922 | Cattaneo | 123/41.41 |
| 1,729,981 | 10/1929 | Bissell | 123/188 AA |
| 1,914,340 | 6/1933 | Holzwarth | 123/41.41 |
| 2,238,628 | 4/1941 | Daisley | 123/188 AA |
| 2,371,548 | 3/1945 | Saffady | 123/188 AA |
| 2,377,459 | 6/1945 | Strauss | 123/188 AA |

FOREIGN PATENT DOCUMENTS

| | | | |
|---|---|---|---|
| 2303699 | 8/1973 | Fed. Rep. of Germany | 123/188 A |
| 1060004 | 11/1953 | France | 123/41.41 |

*Primary Examiner*—Ronald H. Lazarus
*Assistant Examiner*—Jeffrey L. Yates
*Attorney, Agent, or Firm*—Phillips, Moore, Weissenberger, Lempio & Majestic

[57] ABSTRACT

An engine valve comprises an elongated hollow stem having a hollow head secured on an end thereof. A tube is disposed in the stem to define an inlet passage therethrough and an outlet passage between the tube and the stem. An annular oil distributor and heat conducting member, exhibiting a relatively high thermal conductivity, is secured to the tube and is disposed adjacent to an annular face defined on the head of the valve to conduct heat therefrom. The member defines a chamber along with an annular cap secured to the head of the valve. The chamber communicates with the inlet passage and the cap and the member function to direct oil radially outwardly to ports formed through the member to communicate oil to the outlet passage. The tube is preferably bent intermediate its ends to engage the stem in bearing contact to dampen vibration of the tube during operation.

11 Claims, 2 Drawing Figures

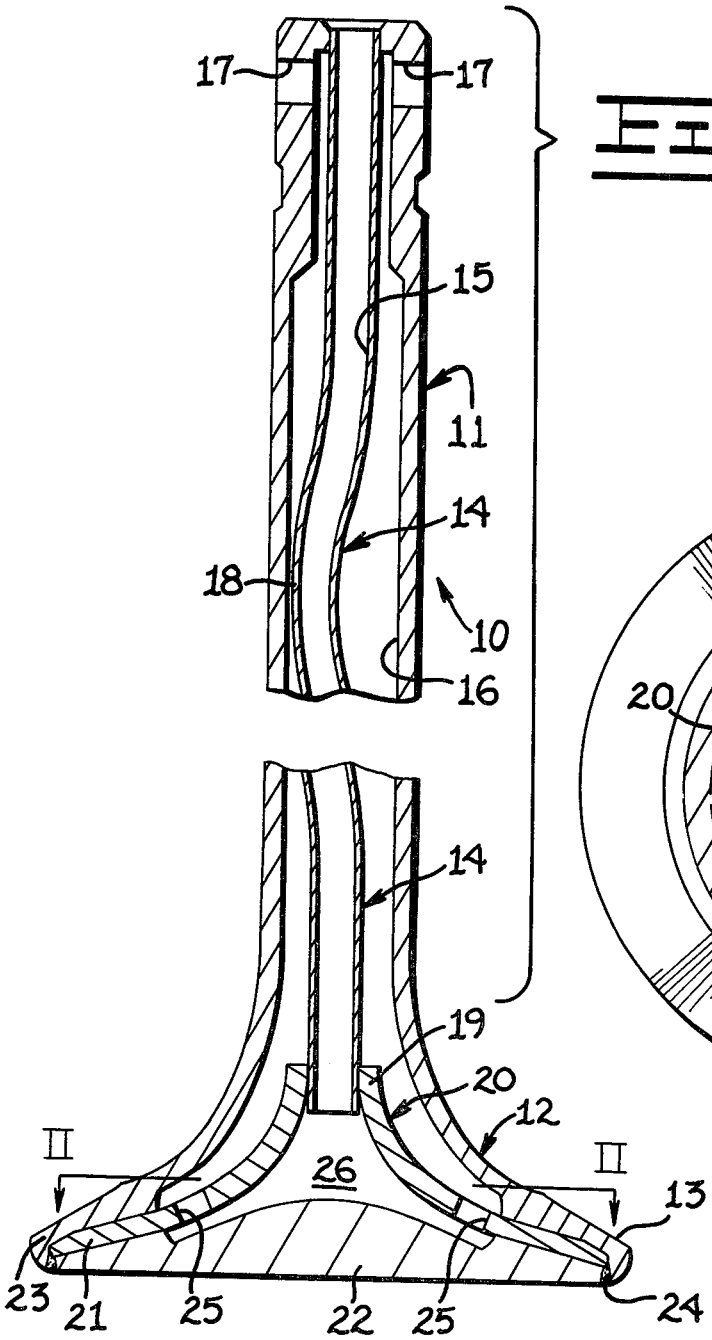
Fig. 1.
Fig. 2.
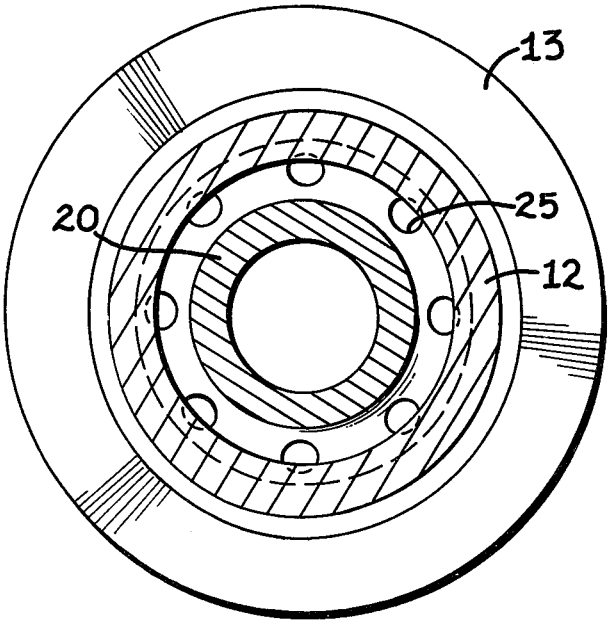

OIL-COOLED ENGINE VALVE

BACKGROUND OF THE INVENTION

This invention relates to an oil-cooled valve adapted for use in an internal combustion engine.

Diesel engines operating on high sulfur fuels, oftentimes containing vanadium compounds, periodically require "top end overhauls" or grinding of the exhaust valves employed therein due to corrosion effects and high heat levels imposed on the valve faces. Such corrosion tends to induce a "channeling" or "guttering" of the valve faces to accelerate corrosion and to give rise to gas leakage past the valves and potential breakage of the valve heads. Such corrosion also occurs on the top of the valve heads which tends to cause severe pitting which may also lead to valve head failures.

Metallurgical solutions have not fully solved the corrosion problem due to the high temperature levels experienced by the valves during operation thereof. Therefore, the state of the art has experienced various attempts to cool such exhaust valves by packing them with metallic sodium or other suitable cooling medium or by circulating oil through the valves. The former attempt has a tendency, for example, to raise the temperature level of the valve stems to thus reduce the service life of the tubular guides reciprocally mounting the valves in an engine.

Also, circulation of oil through the valves for cooling purposes has not provided a final solution to the corrosion problem. In particular, it has proven difficult with conventional valve arrangements of this type to communicate the cooling oil in close proximity to the valve faces whereat the greatest amount of heat dissipation is required. In this connection, the cooling oil communicated to the head of the valve is at least partially trapped thereat to thus prevent a continuous flow and efficient distribution of the cooling oil to the critical surface areas of the valve.

In addition to the corrosion problem, a conventional valve of the latter type, such as that disclosed in U.S. Pat. No. 3,911,875, may have a tube disposed in a hollow stem thereof which tends to vibrate during engine operation. This patent apparently discloses one solution to the vibratory problem by interposing a support piece between the valve stem proper and the tube which is adapted to communicate cooling oil therethrough.

SUMMARY OF THIS INVENTION

The present invention is directed to overcoming one or more of the problems as set forth above.

The improved valve of this invention comprises an elongated stem having a head secured to an end thereof and defining an annular valve face thereon. Circulating means, including a tube secured within the stem to define a first passage therethrough and a second passage between the stem and tube, are provided in the valve for circulating a coolant, such as oil, therethrough. Heat conduction means, including an annular member having a high thermal conductivity and secured in the head of the valve and disposed adjacent to the valve face defined thereon, conducts heat away from the face and to the circulating coolant. The annular member is secured in sandwiched relationship between a cap and the annular member. The dissipation of heat thus substantially reduces the above-discussed corrosion effect to increase the service life of the valve.

Another novel aspect of this invention relates to the construction and arrangement of a slender tube disposed in the stem to form part of the coolant circulating means. The tube has at least one bend formed therein to engage the hollow stem in bearing contact therewith. Thus, vibration of the tube during operation is substantially reduced to increase the service life thereof.

BRIEF DESCRIPTION OF THE DRAWINGS

Other objects of this invention will become apparent from the following description and accompanying drawings wherein:

FIG. 1 is a longitudinal sectional view of an engine valve embodying this invention; and FIG. 2 is a transverse sectional view through a head end of the valve, taken in the direction of arrows II—II in FIG. 1.

DETAILED DESCRIPTION

FIG. 1 illustrates an engine valve 10 comprising an elongated and hollow stem 11 having a hollow head 12 secured to a lower end thereof. The head has an annular valve face 13 formed thereon adapted to engage a like-formed seat defined on the cylinder head of an internal combustion engine. Although the valve is particularly adapted for use as an exhaust valve, since the corrosion and heat problems are of particular concern therewith, it should be understood that the inlet valves for an engine could be constructed in a like manner.

A slender tube 14 is disposed in stem 11 and has a first end thereof disposed centrally within and suitably secured to an upper end of the stem. A first or inlet passage means 15 is defined in the tube whereas a second or outlet passage means 16 is defined between the tube and stem 11. Crankcase oil, preferably constituting the coolant circulated through the herein described circulating means defined in valve 10, is suitably communicated to inlet passage means 15, circulated through the valve as will be hereinafter more fully explained and is discharged through outlet ports 17, formed through the sidewall of the stem to communicate with outlet passage means 16.

Tube 14 preferably has at least one bend 18 formed thereon, between the ends of the tube, to engage stem 11 in bearing contact therewith. Such engagement aids in dampening vibration of the slender tube during reciprocation of the valve in an engine. It should be understood that more than one bend could be formed in tube 14, either in the same plane or in offset relationship relative to each other, e.g., the tube may be suitably twisted to provide two or more bearing contacts with the stem which are offset circumferentially relative to each other.

A second or lower end of tube 14 is suitably secured to an apex end 19 of an annular coolant directing and heat conduction means or member 20. The member is dish-shaped, generally conforming to a hyperboloid, and has an outer radial portion 21 disposed in close proximity to valve face 13. Portion 21 is sandwiched between an annular solid cap 22, closing the lower end of the valve, and an annular portion 23 of head 12 having valve face 13 formed thereon.

Member 20 is preferably composed of a material, such as copper, having a thermal conductivity substantially greater than the material composing stem 11, tube 14, cap 22 and portion 23 of the valve, e.g., an alloy steel. For example, it is desirable that the material composing the conduction means have a thermal conductivitiy which is at least three times the thermal conductivity of the material constituting the remaining portions of the valve. As will be hereinafter more fully understood, the relatively high thermal conductivity of member 20 will aid in dissipating heat in the critical areas of valve, adjacent to face 13.

Outer portion 21 of member 20 may be brazed or otherwise suitably secured to cap 22 and to portion 23 of valve head 12. An annular deposit of silver solder 24 may be utilized to secure cap 22 to portion 23 of the head, whereby the cap forms an integral part of the head. Alternatively, the cap could be welded to the head proper by utilization of laser or electron beam welding techniques to prevent any undue heat penetration to copper member 20 which could cause damage thereto.

Port means, in the form of a plurality of circumferentially disposed ports 25, are formed through member 20 to communicate passage means 15 and 16 with each other via a chamber 26 defined between the member and cap 22. Ports 25 are disposed radially outwardly adjacent to outer extremities of chamber 26 and closely adjacent to valve face 13 to permit the coolant to be directed radially outwardly in close proximity to the valve face to increase the cooling effects thereat. It should be understood that although passage means 15 preferably comprises an inlet passage and that passage means 16 preferably comprises an outlet passage, that the flow pattern could be reversed so that passage means 16 constitutes the inlet passage and that passage means 15 constitutes the outlet passage.

In operation, valve 10 would be suitably mounted in an engine for reciprocation to alternately open and close at valve face 13 to communicate gases to an exhaust manifold. As discussed above, such exhaust gases tend to corrode the valve face, particularly due to the intense heat generated thereby. In order to dissipate such heat, crankcase oil is communicated through inlet passage 15, chamber 26, ports 25 and outlet passage 16 whereby the oil is returned to the engine's crankcase via outlets 17.

Since outer radial portion 21 of copper member 20 extends in close proximity to valve face 13, heat is conducted through the member and is carried-off by the circulating oil. Furthermore, the member and associated cap 21 are constructed and arranged to permit the incoming oil to be distributed in a controlled and continuous flow stream, radially outwardly adjacent to the valve face, to further aid in the heat dissipating function. As suggested above, prior art valves of this type are unable to communicate oil in such close proximity to a respective valve face, primarily due to structural problems encountered, i.e., the resulting thin-walled construction at the head end of the valve would give rise to premature failure. In contrast thereto, the sandwiched arrangement of applicant's conducting means 20, cap 22 and portion 23 of head 12 provides the valve head with a high degree of structural integrity and yet permits oil to be communicated in close proximity to valve face 13.

As further discussed above, one or more bends 18 are formed in tube 14 and arranged to engage stem 11 in bearing contact therewith to dampen vibrations generated in the tube during valve operation. The lateral support thus afforded to the tube will tend to increase the service life thereof.

The embodiments of the invention in which an exclusive property or privilege is claimed are defined as follows:

1. A valve comprising an elongated hollow stem, a head secured to an end of said stem and defining an annular valve face thereon, circulating means in said valve for circulating a coolant therethrough, said circulating means comprising a tube disposed in said stem to terminate at said head and secured between said stem and said head to define a first passage means in said tube and a second passage means between said stem and said tube, heat conduction means secured in said head and disposed in close proximity to said face for conducting heat away from said face and to said coolant, said conduction means comprises an annular member composed of a material having a thermal conductivity substantially higher than the material composing said stem and said head and secured in said head to substantially separate said first and second passage means from each other and wherein radial portions of said member are disposed in close proximity to the valve face formed on said head for conducting heat therefrom, said circulating means further comprising port means formed through said member for communicating said first and second passage means with each other, and an annular separate cap secured on an end of said head and wherein the radial portions of said member are secured in sandwiched relationship between said cap and an annular portion of said head having said valve face defined thereon.

2. The valve of claim 1 wherein said member is dish-shaped and has an apex portion thereof secured to said tube and defining a chamber in said head communicating directly with said first passage means the communicating with said second passage means via said port means formed through said member.

3. The valve of claim 2 wherein said port means comprises a plurality of ports formed through said member and disposed adjacent to outer extremities of said chamber and adjacent to said valve face.

4. The valve of claim 1 wherein the material composing said conduction means has a thermal conductivity at least approximately three times the thermal conductivity of the material composing said stem and said head.

5. The valve of claim 4 wherein the material composing said stem and said head comprises steel and wherein the material composing said conduction means comprises copper.

6. The valve of claim 1 wherein an upper end of said tube is disposed centrally of said stem to form an inlet to said first passage means and further comprising at least one outlet port formed through a sidewall of said stem and communicating with said second passage means to form an outlet therefrom.

7. The valve of claim 1 wherein said tube is bent to engage said stem in bearing contact therewith, between first and second ends of said tube, to stiffen and dampen vibration of said tube during operation of the valve.

8. A valve comprising an elongated hollow stem, a head secured to an end of said stem and defining an annular valve face thereon, a tube disposed in said stem to terminate at said head and secured therein to define first passage means within said tube and second passage means between said tube and said stem, said tube having at least one bend formed therein and disposed in bearing contact with said stem, between first and second ends of said tube, to dampen vibration of said tube during operation of said valve, and means communicating said first and second passage means for circulating a coolant through said valve.

9. The valve of claim 8 wherein a single said bend is formed in said tube.

10. The valve of claim 8 wherein said means communicating said first and second passage means comprises an annular member secured to a lower end of said tube to substantially separate said first and second passage means from each other and port means formed through said member communicating said first and second passage means with each other.

11. The valve of claim 10 wherein said head comprises an annular cap secured on an end of said valve and wherein said member is secured in sandwiched relationship between said cap and an annular portion of said head having said valve face defined thereon.

* * * * *